US006106409A

United States Patent [19]

Jackson, Jr.

[11] Patent Number: 6,106,409

[45] Date of Patent: Aug. 22, 2000

[54] MULTI-SECTION GOLF PRACTICE MAT

[76] Inventor: Charles Henry Jackson, Jr., 6425 Wooster Ave., Los Angeles, Calif. 90056

[21] Appl. No.: 09/263,278

[22] Filed: Mar. 5, 1999

[51] Int. Cl.[7] ..... A63B 69/36

[52] U.S. Cl. ..... 473/278

[58] Field of Search ..... 473/278, 157, 473/279

[56] References Cited

U.S. PATENT DOCUMENTS

| | | | |
|---|---|---|---|
| 2,124,123 | 7/1938 | Rosengarten | 473/278 |
| 3,880,432 | 4/1975 | Coffey et al. | 473/278 |
| 5,026,580 | 6/1991 | Hammon | 428/17 |
| 5,028,052 | 7/1991 | Miller | 273/195 R |
| 5,156,398 | 10/1992 | Kibamoto | 473/278 |
| 5,205,562 | 4/1993 | Hammon | 473/278 |
| 5,340,109 | 8/1994 | Miller | 473/278 |
| 5,456,471 | 10/1995 | MacDonald | 473/278 |
| 5,830,080 | 11/1998 | Reynolds | 473/278 |
| 5,885,168 | 3/1999 | Bair | 473/278 |

FOREIGN PATENT DOCUMENTS

| | | | |
|---|---|---|---|
| 2068740 | 8/1981 | United Kingdom | 273/195 R |

*Primary Examiner*—Mark S. Graham
*Attorney, Agent, or Firm*—Goldstein & Canino

[57] ABSTRACT

A multi-section golf practice mat including a mat having three indented sections formed therein in a spaced relationship. A first mat insert is provided having simulated grass extending outwardly therefrom. The first mat is removably received within a first of the three indented sections of the mat. The simulated grass of the first mat insert corresponds with fringe grass on a golf course. A second mat insert is provided having simulated grass extending outwardly therefrom. The second mat is removably received within a second of the three indented sections of the mat. The simulated grass of the second mat insert corresponding with fairway grass on a golf course. A third mat insert is provided having simulated grass extending outwardly therefrom. The third mat is removably received within a third of the three indented sections of the mat. The simulated grass of the third mat insert corresponds with rough grass on a golf course.

2 Claims, 2 Drawing Sheets

FIG 1
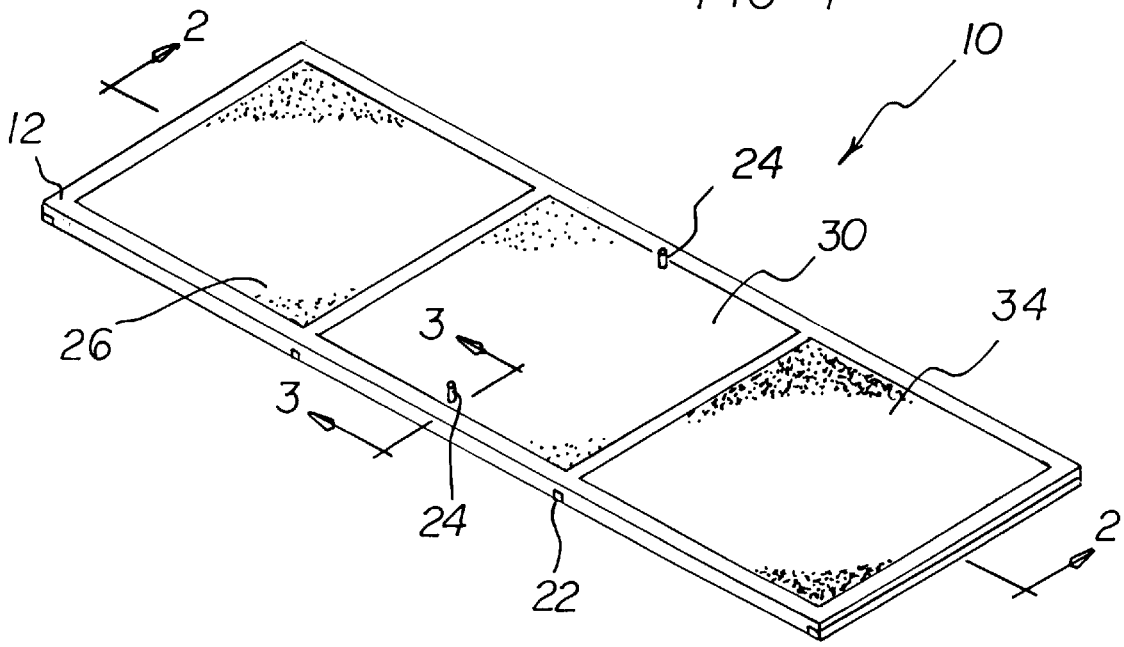
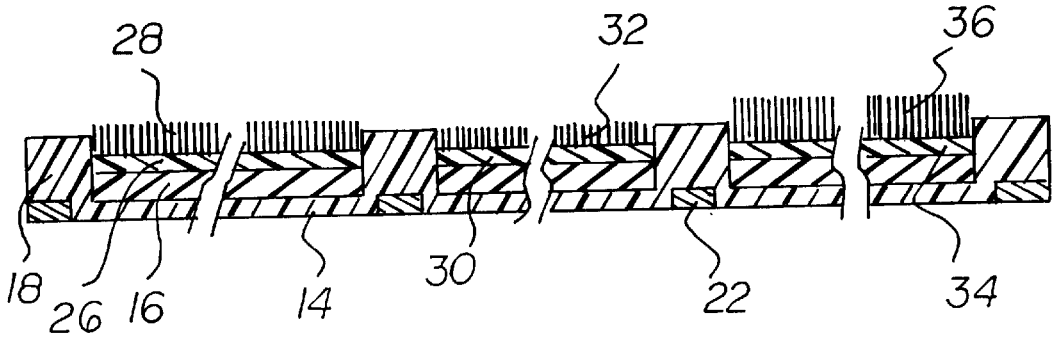
FIG 2

MULTI-SECTION GOLF PRACTICE MAT

BACKGROUND OF THE INVENTION

The present invention relates to a multi-section golf practice mat and more particularly pertains to simulating multiple surfaces that a golfer must hit off of during a round of golf.

Many golf shots require the golfer to swing the golf club such that the head of the club passes through and downwardly of the golf ball position to take a divot out of the ground. Most golf practice facilities utilize rubber mats with artificial turf thereon to hit the golf ball off. This artificial turf provides very little give which in turn does not contribute to the practicing of golf shots in realistic practice settings. Most of the artificial turf used is of a single grade thereby providing very little variety in terms of a golf shot. Additionally, after numerous uses, the artificial turf becomes excessively worn whereby the use of the turf for golfing purposes is minimized.

The present invention seeks to provide a golf mat whereby simulated grass is used and can be easily replaced once it is worn down. Additionally, the golf mat is provided with different grades of grass to simulate the rough, fairway, and fringe of a standard golf course thereby providing a more realistic practice area.

The use of golf simulation devices is known in the prior art. More specifically, golf simulation devices heretofore devised and utilized for the purpose of simulating the game of golf are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,026,580 to Hammon discloses a grass-like golf mat for use at a driving range. U.S. Pat. No. 5,028,052 to Miller discloses a golf mat for practicing shots with the feel of natural turf.

While these devices fulfill their respective, particular objective and requirements, the aforementioned patents do not describe a multi-section golf practice mat for simulating multiple surfaces that a golfer must hit off of during a round of golf.

In this respect, the multi-section golf practice mat according to the present invention substantially departs from the conventional concepts and designs of the prior art, and in doing so provides an apparatus primarily developed for the purpose of simulating multiple surfaces that a golfer must hit off of during a round of golf.

Therefore, it can be appreciated that there exists a continuing need for new and improved multi-section golf practice mat which can be used for simulating multiple surfaces that a golfer must hit off of during a round of golf. In this regard, the present invention substantially fulfills this need.

SUMMARY OF THE INVENTION

In the view of the foregoing disadvantages inherent in the known types of golf simulation devices now present in the prior art, the present invention provides an improved multi-section golf practice mat. As such, the general purpose of the present invention, which will be described subsequently in greater detail, is to provide a new and improved multi-section golf practice mat and method which has all the advantages of the prior art and none of the disadvantages.

To attain this, the present invention essentially comprises a mat having a generally rectangular configuration. The mat includes a lower base layer fabricated of a rigid rubber material. The mat includes an intermediate layer fabricated of a foam rubber material. The mat includes an upper layer fabricated of a rigid rubber material. The upper layer has three indented sections formed therein in a spaced relationship. The lower base layer has a plurality of weights secured therein around a periphery thereof. The mat has a pair of tees secured to the upper layer thereof inwardly of opposed long side edges thereof intermediate opposed short end edges thereof. A first mat insert is provided having simulated grass extending outwardly therefrom. The first mat is removably received within a first of the three indented sections of the mat. The simulated grass of the first mat insert corresponds with fringe grass on a golf course. A second mat insert is provided having simulated grass extending outwardly therefrom. The second mat is removably received within a second of the three indented sections of the mat. The simulated grass of the second mat insert corresponding with fairway grass on a golf course. A third mat insert is provided having simulated grass extending outwardly therefrom. The third mat is removably received within a third of the three indented sections of the mat. The simulated grass of the third mat insert corresponds with rough grass on a golf course.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved multi-section golf practice mat which has all the advantages of the prior art golf simulation devices and none of the disadvantages.

It is another object of the present invention to provide a new and improved multi-section golf practice mat which may be easily and efficiently manufactured and marketed.

It is a further object of the present invention to provide a new and improved multi-section golf practice mat which is of durable and reliable construction.

An even further object of the present invention is to provide a new and improved multi-section golf practice mat which is susceptible of a low cost of manufacture with regard to both materials and labor, and which accordingly is then susceptible of low prices of sale to the consuming public, thereby making such a multi-section golf practice mat economically available to the buying public.

Even still another object of the present invention is to provide a new and improved multi-section golf practice mat for simulating multiple surfaces that a golfer must hit off of during a round of golf.

Lastly, it is an object of the present invention to provide a new and improved multi-section golf practice mat including a mat having three indented sections formed therein in a spaced relationship. A first mat insert is provided having simulated grass extending outwardly therefrom. The first mat is removably received within a first of the three indented sections of the mat. The simulated grass of the first mat insert corresponds with fringe grass on a golf course. A second mat insert is provided having simulated grass extending outwardly therefrom. The second mat is removably received within a second of the three indented sections of the mat. The simulated grass of the second mat insert corresponding with fairway grass on a golf course. A third mat insert is provided having simulated grass extending outwardly therefrom. The third mat is removably received within a third of the three indented sections of the mat. The simulated grass of the third mat insert corresponds with rough grass on a golf course.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment of the multi-section golf practice mat constructed in accordance with the principles of the present invention.

FIG. 2 is a cross-sectional view of the present invention as taken along line 2—2 of FIG. 1.

The same reference numerals refer to the same parts through the various figures.

DESCRIPTION OF THE PREFERRED EMBODIMENT

Figure 3:
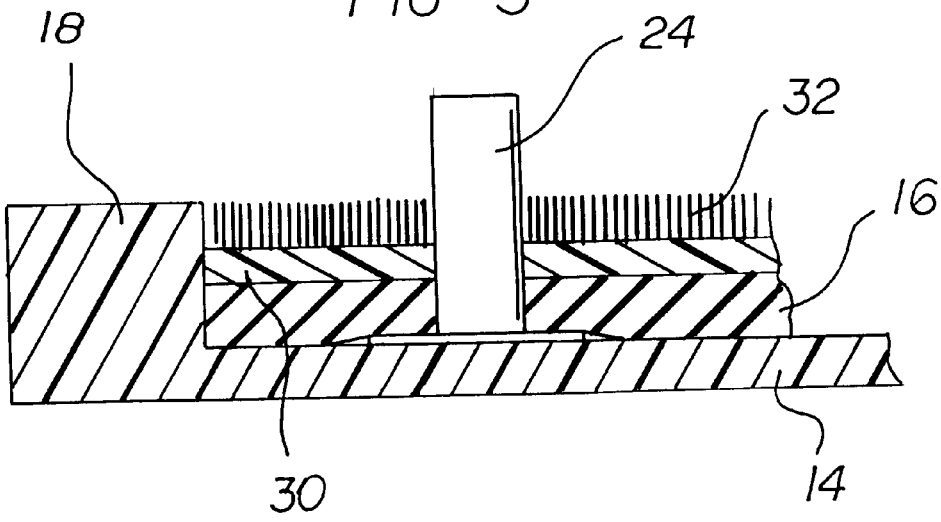
FIG. 3 is a cross-sectional view of the present invention as taken along line 3—3 of FIG. 1.
Figure 4:
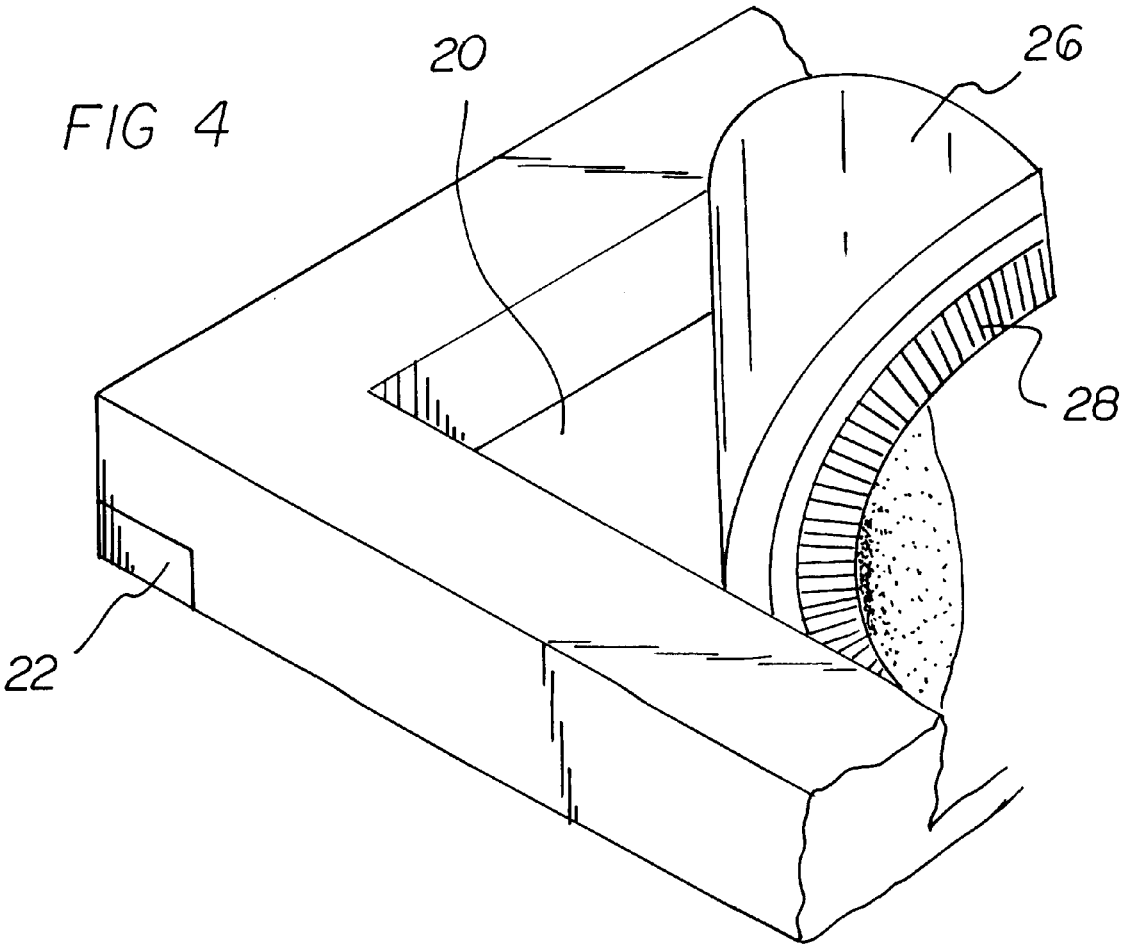
FIG. 4 is a partial perspective view of the present invention illustrating the removability of the simulated grass sections.

With reference now to the drawings, and in particular, to FIGS. 1 through 4 thereof, the preferred embodiment of the new and improved multi-section golf practice mat embodying the principles and concepts of the present invention and generally designated by the reference number 10 will be described.

Specifically, it will be noted in the various Figures that the device relates to a multi-section golf practice mat for simulating multiple surfaces that a golfer must hit off of during a round of golf. In its broadest context, the device consists of a mat, a first mat insert, a second mat insert, and a third mat insert. Such components are individually configured and correlated with respect to each other so as to attain the desired objective.

The mat 12 has a generally rectangular configuration. The mat 12 includes a lower base layer 14 fabricated of a rigid rubber material. The mat 12 includes an intermediate layer 16 fabricated of a foam rubber material. The mat 12 includes an upper layer 18 fabricated of a rigid rubber material. The upper layer 18 has three indented sections 20 formed therein in a spaced relationship. The lower base layer 14 has a plurality of weights 22 secured therein around a periphery thereof. The mat 12 has a pair of tees 24 secured to the upper layer 18 thereof inwardly of opposed long side edges thereof intermediate opposed short end edges thereof. The positioning of the tees 24 provides for usage by both right and left-handed players.

The first mat insert 26 has simulated grass 28 extending outwardly therefrom. The first mat 26 is removably received within a first of the three indented sections 20 of the mat 12. The simulated grass 28 of the first mat insert 26 corresponds with fringe grass on a golf course.

The second mat insert 30 has simulated grass 32 extending outwardly therefrom. The second mat 30 is removably received within a second of the three indented sections 20 of the mat 12. The simulated grass 32 of the second mat insert 30 corresponds with fairway grass on a golf course.

The third mat insert 34 is has simulated grass 36 extending outwardly therefrom. The third mat 34 is removably received within a third of the three indented sections 20 of the mat 12. The simulated grass 36 of the third mat insert 34 corresponds with rough grass on a golf course.

All of the mat inserts can be removed from the mat 12 when in need of replacement. The heights and thicknesses of the simulated grass can be altered to suit the needs of various users.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A multi-section golf practice mat for simulating multiple surfaces that a golfer must hit off of during a round of golf comprising, in combination:

a mat having a generally rectangular configuration, the mat including a lower base layer fabricated of a rigid rubber material, the mat including an intermediate layer fabricated of a foam rubber material, the mat including an upper layer fabricated of a rigid rubber material, the upper layer having three indented sections formed therein in a spaced relationship, the lower base layer having a plurality of weights secured therein around a periphery thereof, the mat having a pair of tees secured to the upper layer thereof inwardly of opposed long side edges thereof intermediate opposed short end edges thereof;

a first mat insert having simulated grass extending outwardly therefrom, the first mat being removably received within a first of the three indented sections of the mat, the simulated grass of the first mat insert corresponding with fringe grass on a golf course;

a second mat insert having simulated grass extending outwardly therefrom, the second mat being removably received within a second of the three indented sections of the mat, the simulated grass of the second mat insert corresponding with fairway grass on a golf course;

a third mat insert having simulated grass extending outwardly therefrom, the third mat being removably received within a third of the three indented sections of the mat, the simulated grass of the third mat insert corresponding with rough grass on a golf course.

2. A multi-section golf practice mat for simulating multiple surfaces that a golfer must hit off of during a round of golf comprising, in combination:

a mat having three indented sections formed therein in a spaced relationship, said mat comprising a lower base layer fabricated of a rigid rubber material, an intermediate layer fabricated of a foam rubber material, and an upper layer fabricated of a rigid rubber material;

a first mat insert having simulated grass extending outwardly therefrom, the first mat being removably received within a first of the three indented sections of the mat, the simulated grass of the first mat insert corresponding with fringe grass on a golf course;

a second mat insert having simulated grass extending outwardly therefrom, the second mat being removably received within a second of the three indented sections of the mat, the simulated grass of the second mat insert corresponding with fairway grass on a golf course;

a third mat insert having simulated grass extending outwardly therefrom, the third mat being removably received within a third of the three indented sections of the mat, the simulated grass of the third mat insert corresponding with rough grass on a golf course.

* * * * *